US007111578B2

(12) United States Patent
Brooks et al.

(10) Patent No.: US 7,111,578 B2
(45) Date of Patent: Sep. 26, 2006

(54) WATERCRAFT COVER

(75) Inventors: Gary C. Brooks, Hastings, MN (US); Gregory T. Kassuelke, Cold Spring, MN (US)

(73) Assignee: Canvas Innovations LLC, Hastings, MN (US)

( * ) Notice: Subject to any disclaimer, the term of this patent is extended or adjusted under 35 U.S.C. 154(b) by 0 days.

(21) Appl. No.: 11/355,727

(22) Filed: Feb. 16, 2006

(65) Prior Publication Data

US 2006/0137593 A1 Jun. 29, 2006

Related U.S. Application Data

(62) Division of application No. 10/828,593, filed on Apr. 21, 2004, now Pat. No. 7,032,532.

(60) Provisional application No. 60/474,432, filed on May 30, 2003.

(51) Int. Cl.
*B63B 17/02* (2006.01)
*E04H 15/06* (2006.01)

(52) U.S. Cl. ..... 114/361; 135/88.01

(58) Field of Classification Search ..... 114/361; 135/88.01, 88.03, 88.12
See application file for complete search history.

(56) References Cited

U.S. PATENT DOCUMENTS 2,811,728 A 11/1957 Litsheim
3,354,892 A 11/1967 Frieder
3,604,440 A 9/1971 Wilson
3,896,832 A 7/1975 Montoya
3,960,162 A 6/1976 Noel
4,075,723 A 2/1978 Bareis et al.
4,979,457 A 12/1990 Sommerhauser et al.
5,031,566 A 7/1991 Switzer
5,070,807 A 12/1991 Lewis
5,228,408 A 7/1993 Jannausch
5,441,066 A 8/1995 Harris
5,449,032 A 9/1995 Blevins et al.
5,809,929 A 9/1998 Garnes
5,850,799 A 12/1998 Geisel et al.
6,129,034 A 10/2000 Santa Cruz et al.
6,286,449 B1 9/2001 Giffin
6,623,322 B1 9/2003 Lesniak

*Primary Examiner*—Jesús D. Sotelo
(74) *Attorney, Agent, or Firm*—Fredrikson & Byron, P.A.

(57) ABSTRACT

The invention relates to an improved watercraft cover, as well as its method of use. In some embodiments, the watercraft cover's support structure is normally irreversibly integrated into or retained by a sheet of the watercraft cover, and the support structure and the sheet are collapsible together for portability without separating the support structure and sheet. The invention also provides for improved retention systems useful for retaining the watercraft cover on the watercraft. Watercraft covers in accordance with the present invention are particularly useful for providing improved portability while preventing water collection.

18 Claims, 18 Drawing Sheets

WATERCRAFT COVER

This application is a divisional of U.S. application Ser. No. 10/828,593, filed Apr. 21, 2004, now U.S. Pat. No. 7,032,532, which claims priority to U.S. Provisional Application Ser. No. 60/474,432, filed May 30, 2003, the disclosure of which is herein incorporated by reference.

FIELD OF THE INVENTION

The present invention relates to a watercraft cover, and more particularly to a watercraft cover useful for providing for portability while preventing water collection.

BACKGROUND OF THE INVENTION

Boat covers are used to protect a boat's helm, deck and other inner areas from adverse weather conditions. The available covers have variable success in keeping water out of the boats. Many are also susceptible to mildew and rot by having portions of the cover under water due to loss of tautness in the materials which allow sagging and hence accumulation of water in certain portions.

Currently, many available covers do not provide for ease of portability. That is, they do not provide for a cover that is easily collapsible and storable for immediate reuse. Such prior art covers use various combinations of adjustable poles, metal tube frames, grommets, and fasteners which complicate their assembly. As examples of the art, see U.S. Pat. Nos. 6,129,034, 5,809,929, 5,479,872, 5,449,032, 5,228,408, 5,031,566, 4,979,457. The large number of parts needed for assembly usually results in increased time and effort required for assembly and attachment of the cover to the watercraft, and may provide slack within the material, which retains water and thereby damages the cover.

SUMMARY OF THE INVENTION

The present invention provides for a watercraft cover useful for protecting a watercraft's inner areas from adverse weather conditions. The watercraft cover of the present invention is designed to be readily collapsible and portable while holding the cover tight to prevent sagging and water collection. Some embodiments of the present invention accomplish this design by providing a cover sheet integral with its support structure and/or improved retention systems for holding the cover against a watercraft. In this instance, "integral" means the support structure is normally irreversibly retained by the sheet. The watercraft cover of the present invention may be adjustable to fit a variety of boat sizes, and many embodiments provide for relatively easy assembly and retention to a watercraft. Some embodiments of the watercraft cover are particularly suitable for covering an inflatable type watercraft, although they are not limited to that use. Other embodiments of the watercraft cover are suitable for covering the watercraft both while it is docked and while it is in transit (e.g., while the watercraft is secured on a trailer and towed by a vehicle).

In some embodiments, the present invention includes a watercraft cover which has at least one support structure which may be normally irreversibly integrated into or retained by the cover. Such a feature allows for the watercraft cover to be collapsed for portability without separating its support structure and its sheet. Such an embodiment allows for portability and prevents water collection on the sheet. The invention also includes the method of using such a watercraft cover.

Some embodiments of the present invention are useful for providing a travel watercraft cover. In such embodiments, a dual retention system attached to the cover may be provided. The dual retention system may include a first relatively elastic cord and a second relatively inelastic cord. Such an embodiment allows for secure attachment without large gaps in the cover. The invention also includes the method of using such a travel cover.

Some embodiments of the present invention are particularly suited for covering an inflatable type watercraft. In some of these embodiments, at least three cover gathering means are included. The at least three cover gathering means may be secured to the cover and adapted for tightening the cover around the outer edges of the watercraft. At least one cover gathering means may be configured to secure the aft end of the watercraft cover by engaging a pontoon of the watercraft. Such an embodiment provides for an improved fit between the cover and the watercraft. The invention also includes the method of using such a watercraft cover.

DESCRIPTION OF THE DRAWINGS

FIG. 14(*b*) is a side view of a watercraft cover in accordance with an embodiment of the present invention.

FIG. 16(*b*) is a side view of an adjustable pocket in accordance with an embodiment of the present invention in a first position.

FIG. 16(*c*) is a side view of an adjustable pocket in accordance with an embodiment of the present invention in a second position.

DETAILED DESCRIPTION OF THE PREFERRED EMBODIMENTS

Figure 1:
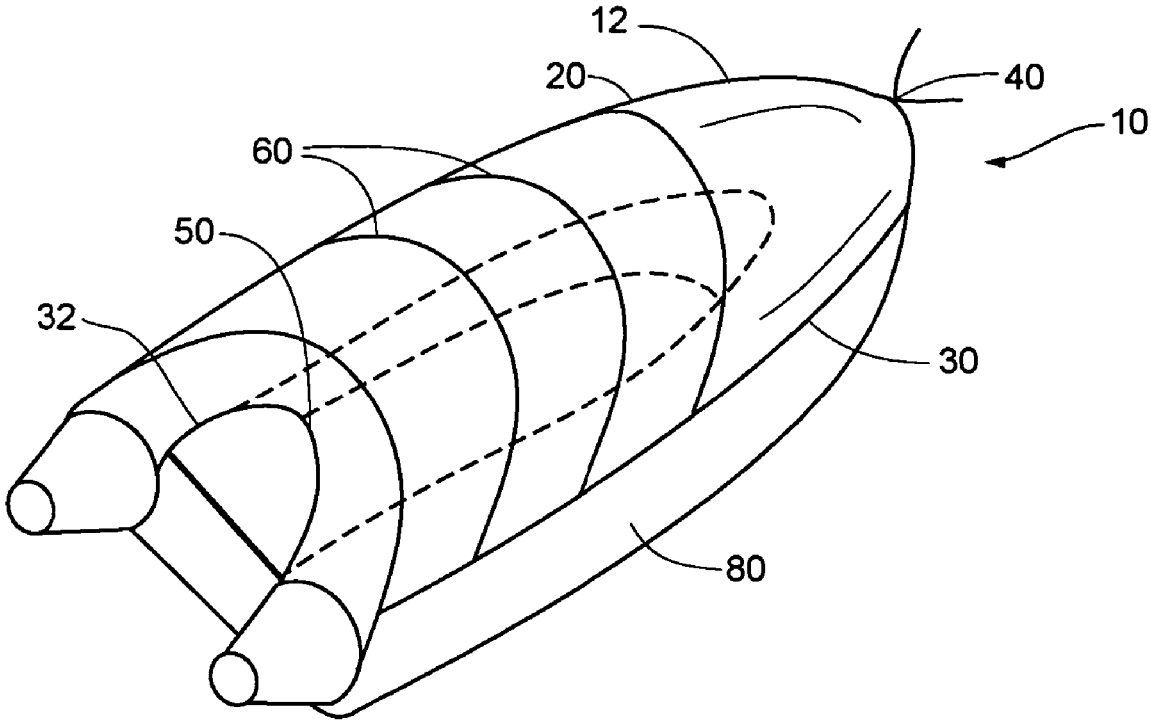
FIG. 1 is a perspective view of a watercraft cover in accordance with an embodiment of the present invention positioned on a watercraft.

The following detailed description is to be read with reference to the drawings. The drawings, which are not necessarily to scale, depict selected embodiments, but are not intended to limit the scope of the invention. It will be understood that many of the specific details of the watercraft cover illustrated in the drawings could be changed or modified by one of ordinary skill in the art without departing significantly from the spirit of the invention.

Various embodiments of the watercraft cover of the present invention allow a boat to be covered when it is not in use, both while the boat is docked and when it is in land transit while secured to a trailer. This cover is easily assembled at the time of installation and need not be disassembled and then reassembled when it is removed from and repositioned on the watercraft. Therefore, the watercraft cover of the present invention provides for increased portability. Further, embodiments of the present invention provide for improved support and retention assemblies that allow for secure retention of the cover to the watercraft and prevent sagging of the cover material. The cover is constructed to have a low profile or arch which deflects wind yet sheds water. The cover is not designed nor intended as a personal shelter. The invention is meant to be assembled and held substantially above the water line relative to the watercraft. The cover is intended to be light weight and may be stored uninstalled with all parts in the boat when the boat is in use.

Covers in accordance with the present invention are suitable for covering watercraft, such as a boat, and fit watercraft of various sizes, including open deck, inflatable, and pontoon style watercraft. Some embodiments of the invention use a support structure, such as a rib, integral to the cover whose ends fit into pockets towards the edges of the cover. The arch shape defined varies depending on the width of the boat. The arch shape is substantially retained by adjustable straps which provide a counterforce to the support structures. In some embodiments, the beam or width of a boat determines the height of the arch given a fixed length of the support structure. Other embodiments use adjustable pockets which allow the height of the arc to be adjusted given a fixed support structure length and watercraft width. The length of the watercraft determines the number of support ribs required. In some embodiments, the distance between the support structures is approximately 24 to 30 inches.

FIG. 1 shows the elements of an embodiment of the watercraft cover 10 secured to a watercraft 80. Cover 10 includes a sheet 12. The sheet 12 may be any material useful for deflecting wind and shedding water. In some embodiments, the sheet 12 comprises canvas.

In embodiments particularly suitable for covering inflatable type watercraft, at least three cover gathering means are provided. These cover gathering means provide for an improved fit, and are flexible enough to allow the cover 10 to be secured to the watercraft 80 when an engine (not shown) is attached to the aft end of watercraft 80. Some embodiments of the watercraft cover 10 have a port side means of cover gathering 20 within the cover and a starboard side means of cover gathering 30 also within the cover which meet at the bow tension point 40. Watercraft cover 10 may also include an aft cord 32 which gathers the sheet 12 at the aft end of the watercraft 80, which is tightened and secured at aft tension point 50. The three cover gathering means work together to provide an improved fit and retain the cover 10 against the watercraft 80. All such cover gathering means may be attached without docking the boat and without entering the body of water. The means of cover gathering may be a cord, a cord with elastic properties, mechanical fasteners, or any device which gathers the sheet 12 to the boat's surface. Cords will be used as a non-limiting example within the following description. The cords pull at their respective sides to gather the cover around the edges of the boat and meet into a tension device that secures the desired tension at the edges of the cover.

The cover 10 may also contain support structures 60. Support structures 60 may be secured on one side of the cover which are configured to allow an arch or rounded shape in order to promote the shedding of water from the cover. The support structures 60 may be composed of any flexible material, such as fiberglass, a polymer composite or incorporate a metallic substance to achieve a desired balance of flexibility and strength. In addition, support structures 60 may be of any cross-sectional shape suitable for supporting cover 10, such as a square or a circle.

Figure 2:
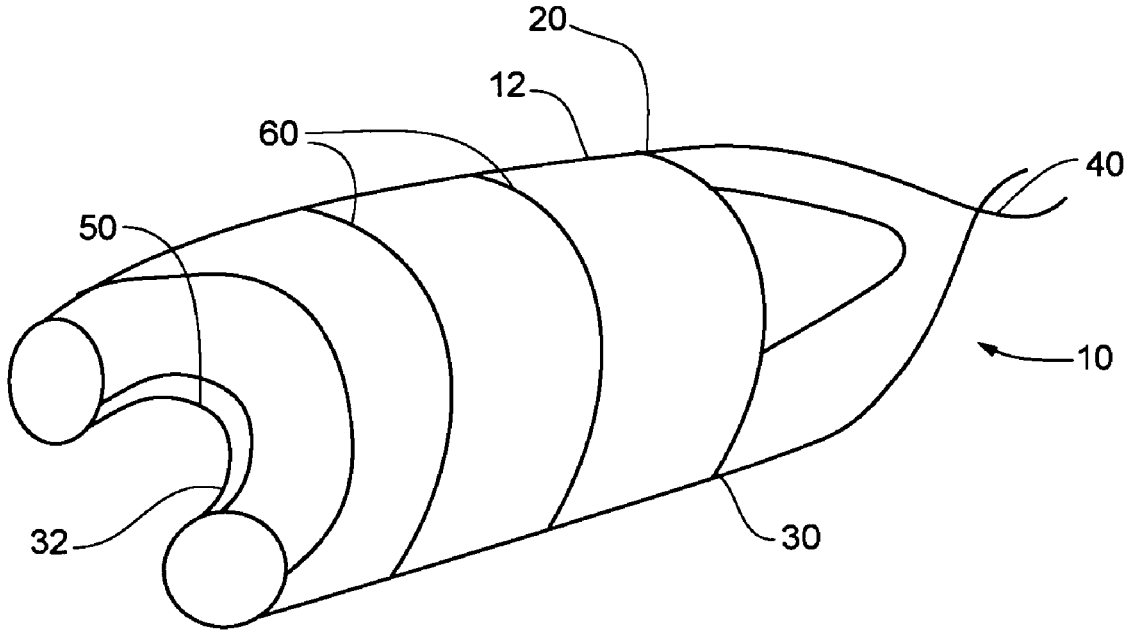
FIG. 2 is a perspective view of a watercraft cover in accordance with an embodiment of the present invention.

FIG. 2 shows the cover and its elements assembled but not attached to a watercraft. In the embodiment of FIG. 2, watercraft cover 10 has the portside cord 20, starboard side cord 30 which meet at the bow tension point 40. The support structures 60 are secured on the opposing edges of the sheet 12. The aft cord 32 is shown running through the sheet 12 towards the aft end of the cover 10. The ends of the aft cord 32 come together at the aft tension point 50 in order to secure the cover 10 and enclose around the aft portion of the watercraft.

Figure 3:
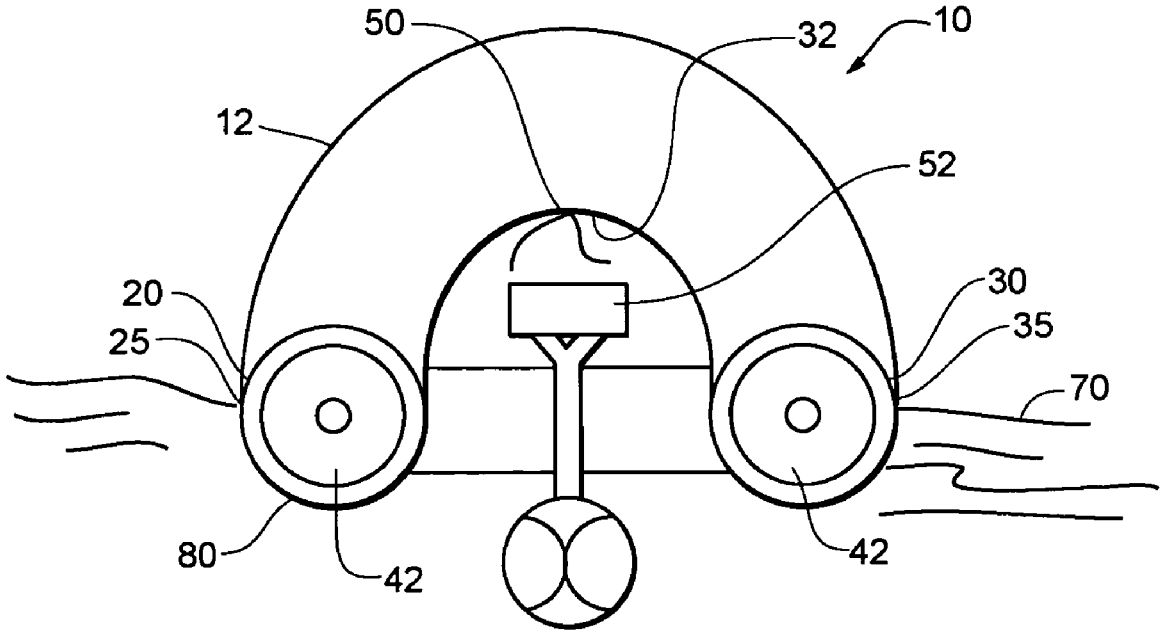
FIG. 3 is a rear view of a watercraft cover in accordance with an embodiment of the present invention positioned on a watercraft.

FIG. 3 is a rear view of an embodiment of the invention on a partially inflatable watercraft 80. In the embodiment of FIG. 3, the port side cord 20 wraps around the inflatable port side pontoon portion 42 in order to secure the cover 10 to that side of the watercraft 80. The cover 10 is partially secured at connection point 25. The cover's 10 sheet 12 stretches towards and somewhat over an attached engine 52. The starboard side cord 30 wraps around the starboard side inflatable pontoon portion 42 in order to secure that side of the cover 10 to the watercraft 80. The cover 10 is further secured at opposite connection point 35. The material in the aft portion of the cover 10 is gathered together and held in position by the aft cord 32 meeting at the aft tension point 50. Aft cord 32 is held against inflatable pontoon portions 42 to secure the aft end of the cover 10 to the watercraft 80. In FIG. 3, the waterline 70 is in retrospect to the cover 10 and the watercraft 80 to illustrate that the cover 10 is intended to be kept substantially above the waterline to prevent damage to the cover 10.

Figure 4:
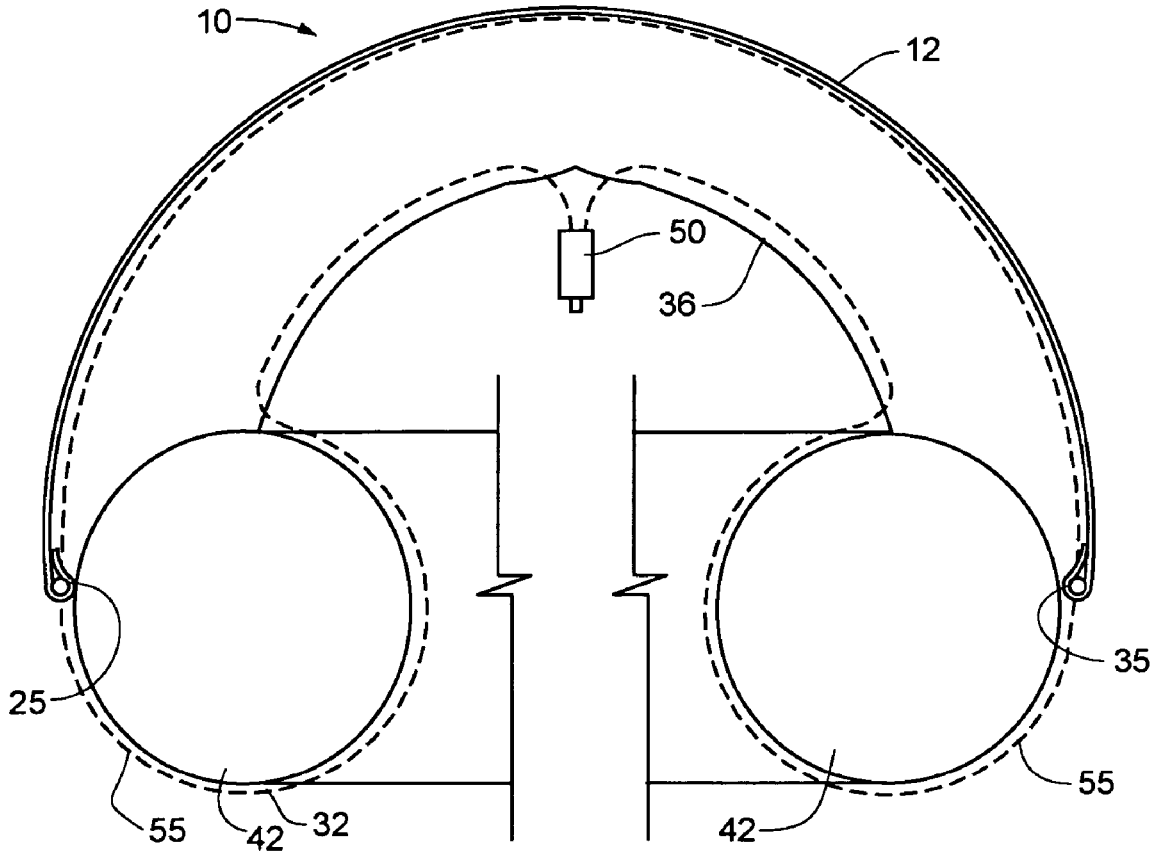
FIG. 4 is a schematic of the rear of a watercraft cover in accordance with an embodiment of the present invention.

FIG. 4 illustrates the positioning of an embodiment of the aft cord relative to the cover 10, the aft edge of the cover is 36, the port side contact between cover and boat is 25, the starboard side contact point between cover and watercraft is 35. The aft cord 32 runs through the cover 10 behind the last support structure and in this example goes around the inflatable pontoon portions 42 of a partially inflatable watercraft, continues through the aft edge 36 of the material and the ends meet at the aft tension point 50. The broken lines in the center of the diagram simply indicate a space for the deck of the watercraft and is not meant to indicate actual proportions.

Figure 5:
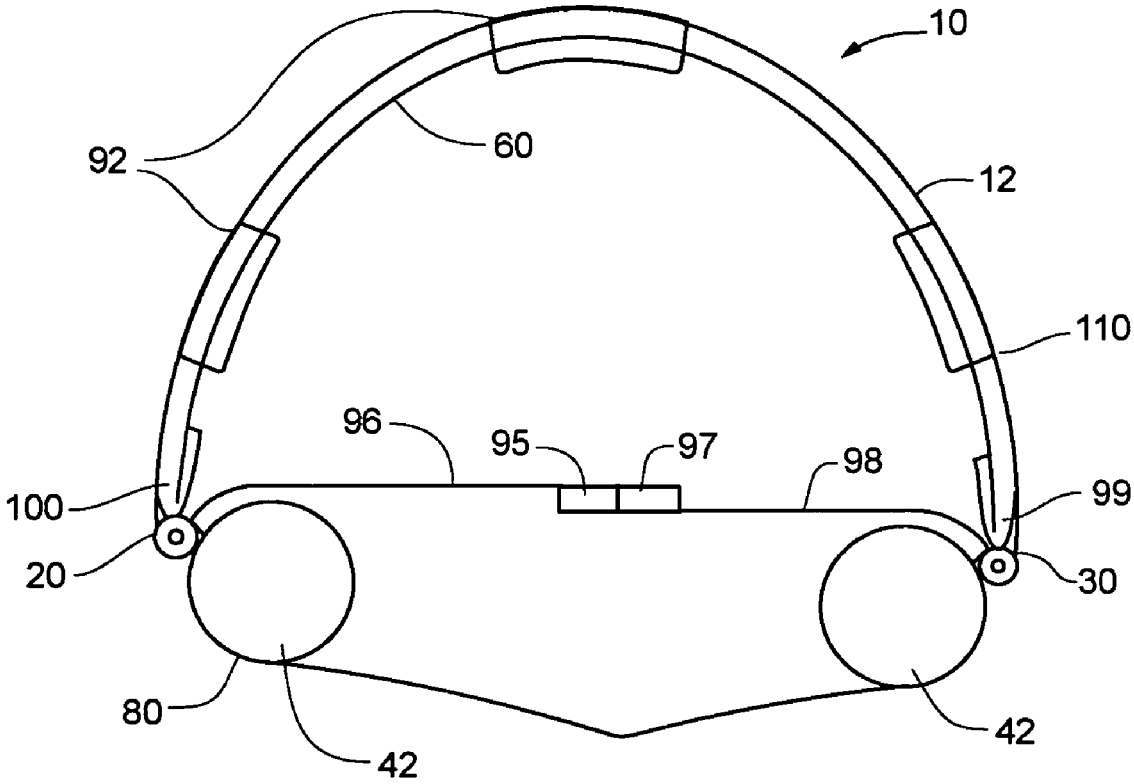
FIG. 5 is a cross-sectional view of the rear of a watercraft cover in accordance with an embodiment of the present invention positioned on a watercraft.

FIG. 5 is a cross sectional diagram of an embodiment of the cover 10 positioned on a watercraft 80. A port side pocket 100 proximate port cord 20 is suitable for receiving first end of support structure 60. The support structure 60 moves through sleeves 92 which are attached to the sheet 12 and a second end of the support structure 60 is received at the opposite pocket 99 which is proximate to the starboard cord 30. A connection strap 96 has a fist end functionally coupled to the sheet proximate port cord 20 and a second end connected to a buckle 95 which attaches to a corresponding connector 97 that is attached to the opposite strap 98 functionally connected to the sheet proximate starboard cord 30. In some embodiments, straps 96 and 98 may be functionally connected to sheet 12 proximate pockets 100 and 99. Of course, buckle 95 and corresponding connector 97 may be any device capable of connecting or tightening straps 96 and 98 together, and straps 96 and 98 may be one strap provided with tightening means. Further, straps 96 and 98 are not required to follow a straight line. For example, they could maneuver around and/or rest against watercraft components such as seats. The pockets 99 and 100 may be continuations of the sheet 12. Alternatively, the pockets may be constructed of a different material and may be detachable and positioned on the outside or inside of the sheet 12. Furthermore, the supports 60 can be positioned within or on the sheet 12. As with the pockets 99 and 100, the supports 60 may be positioned on the outside or inside the sheet 12. When straps are connected at the buckle devices 95 and 97, the opposite ends of the support structures 60 are pulled towards each other to form an arch. The tension straps 96 and 98 enable pulling the cover towards the edge of the watercraft 80 forming a shape which channels water off the cover and prevents depressions in the sheet 12 which could gather water.

Figure 6:
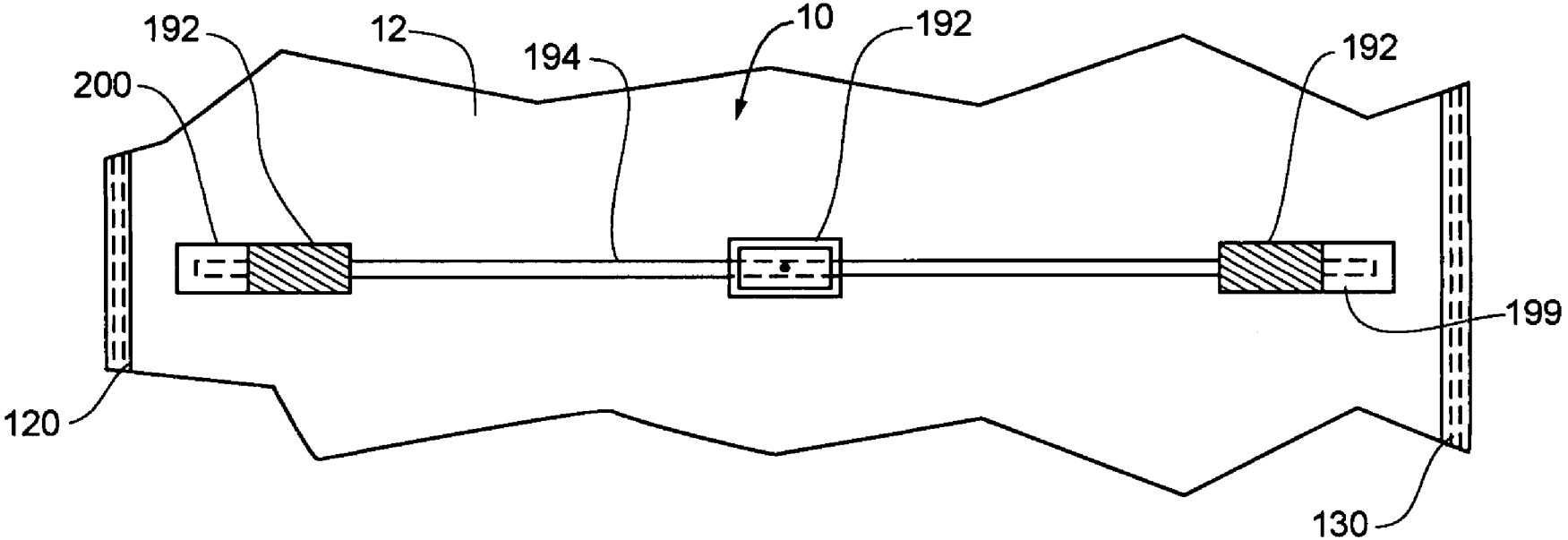
FIG. 6 is sectional view of a support structure assembly in accordance with an embodiment of the present invention.

FIG. 6 shows a section of an embodiment of the cover 10 and its support structure 194. The cover 10 may include many such sections spaced along the length of the cover 10 to prevent water collection, such as every 24–30 inches. A port cord 120 is proximate to port pocket 200 with a sleeve 192 which secures support structure 194. In the opposite or potentially starboard side is a pocket 199 proximal to the starboard cord 130, all of which are attached to the sheet 12.

Figure 7:
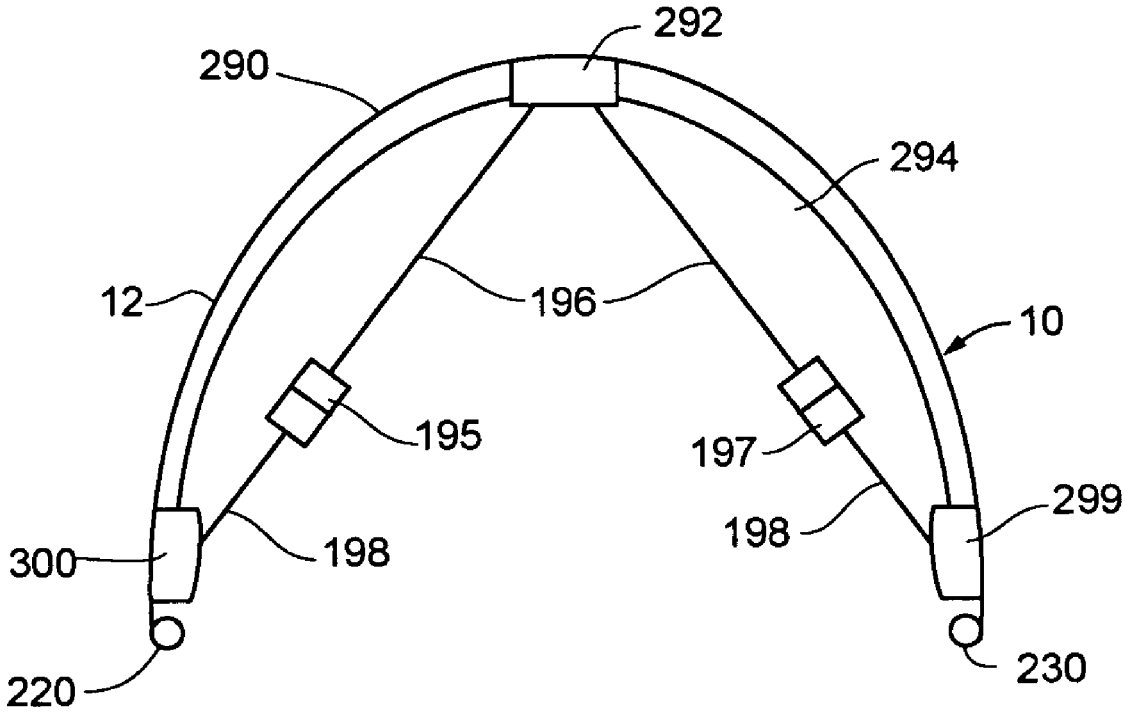
FIG. 7 is a cross-sectional view of the rear of a watercraft cover in accordance with an alternate embodiment of the present invention.

FIG. 7 is an alternative embodiment of creating the curve in the support structure beneath the cover 10. Port cord 220 is proximal to a port pocket 300 which has a support structure 294 inserted at pocket 300. The support structure 294 is positioned through a sleeve 292 and inserted at the opposite side into pocket 299, which is proximal to starboard cord 230. Opposite tension strap 196 emerges from the area of the sleeve 292 at an acute angle to the sheet 12 and at its opposite end is coupled to connection devices 195 and 197, which attach to tension straps 198 which have the area proximate pockets 300 and 299 as their origin. These tension straps, when fully connected, form an acute angle to the apex of the sheet 12. They are configured to additionally pull the support structures in a downward direction to create the curve as compared to the tension straps in FIG. 5, which form the curve by holding the ends of the support structures towards one another.

Figure 8:
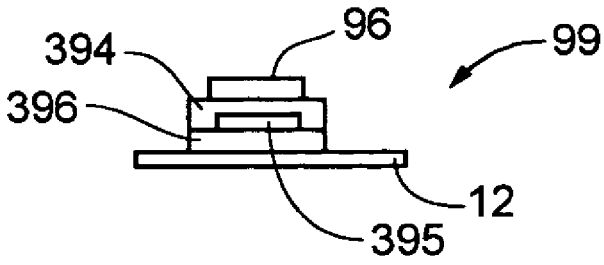
FIG. 8 is a top plan view of a support structure pocket in accordance with an embodiment of the present invention.

FIG. 8 shows a pocket 99 formed by an moveable section 394 connected to a fixed section 396 to create the pocket's open end 395. The assembly is attached to the sheet 12 and shows a tension strap 96 in relation to a topside view of the pocket.

Figure 9:
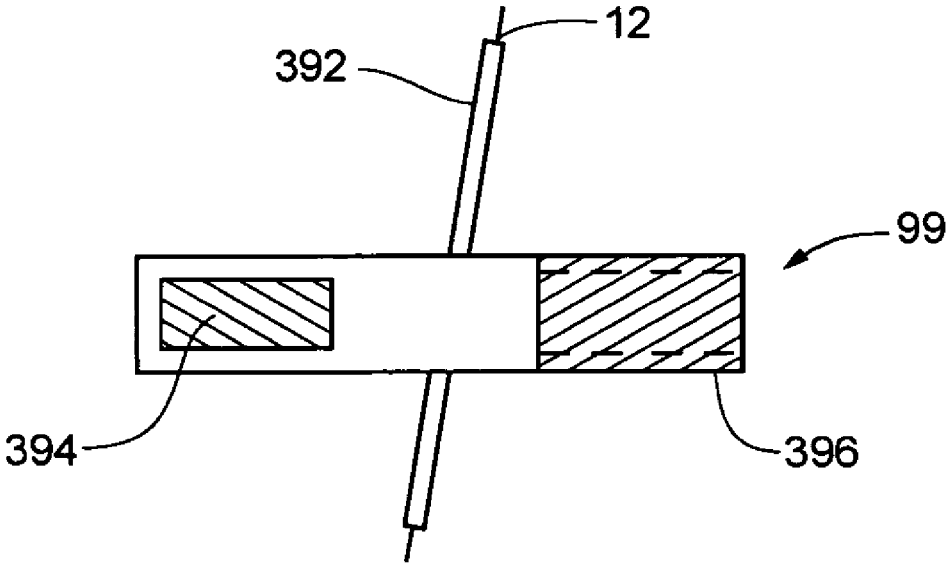
FIG. 9 is a side plan view of a pocket in accordance with an embodiment of the present invention.

FIG. 9 shows the same pocket in an opened position showing moveable portion 394 in relation to the cover edge 392 of the sheet 12, and the fixed portion of the pocket 396. The pocket is formed by moveable portion 394 folding over to be secured to the fixed portion 396. The material to form this connection may, for example, be the loop and hook construction of material known as Velcro™ or other mechanical methods.

Figure 10:
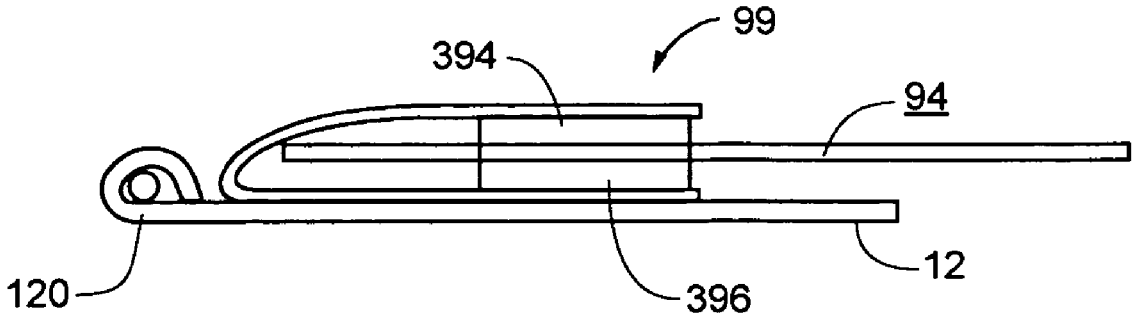
FIG. 10 is a side view of a pocket and a support structure in accordance with an embodiment of the present invention.

FIG. 10 shows a fully assembled pocket 99 with its moveable section 394 connected to its fixed section 396 attached to the sheet 12. The support structure 94 is shown inserted into this pocket. The whole assembly is shown in relation to a tension cord 120 at the edge of the material.

Figure 11:
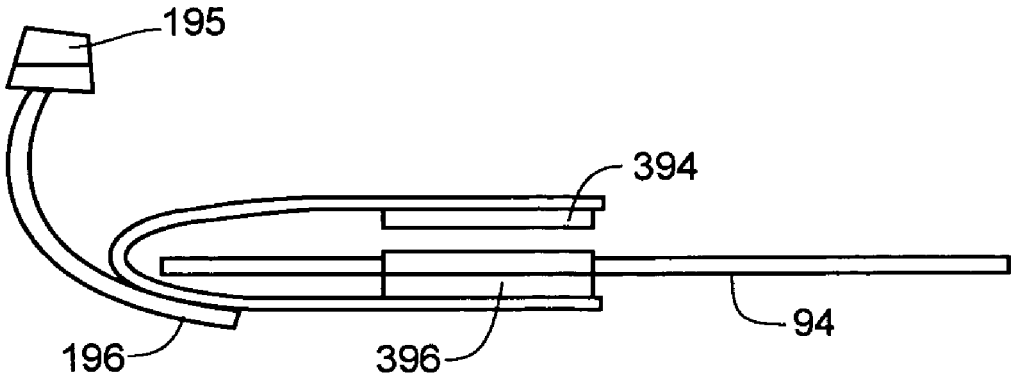
FIG. 11 is a side view of a pocket, support structure, and tension strap in accordance with an embodiment of the present invention.

FIG. 11 first shows the pocket with the moveable section 394 slightly detached from the fixed section 396 with the support structure 94 inserted into the space. The tension strap 196 is shown attached to the pocket with the opposite end of the strap attached to one portion of the tension buckle 195.

Figure 12A:
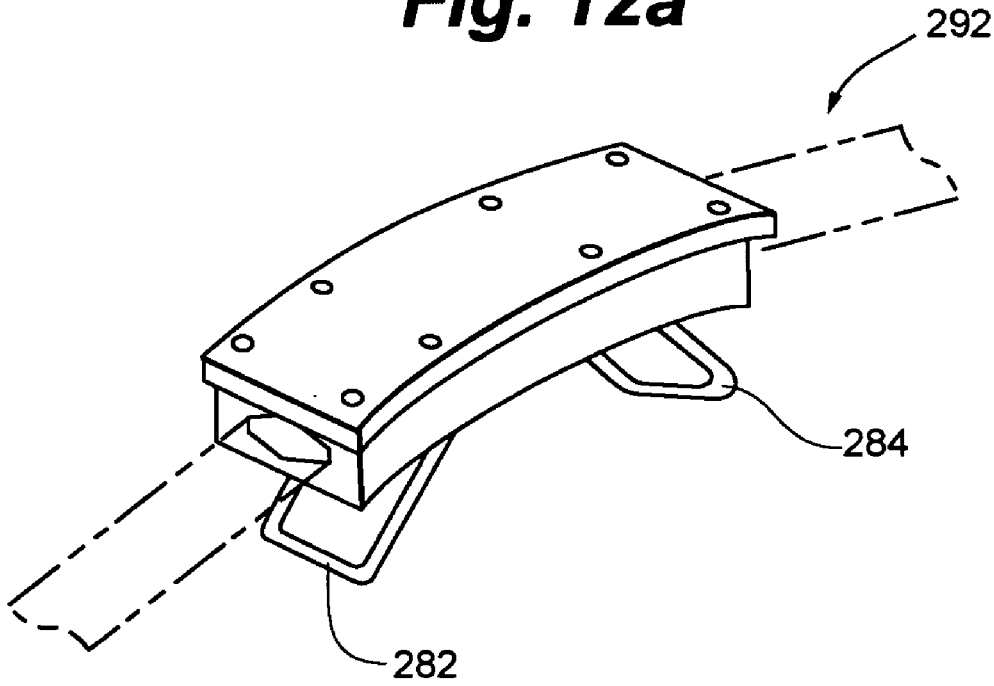
FIG. 12 shows several tension strap connectors in accordance with some embodiments of the present invention.

FIG. 12 illustrates alternate embodiments of the tension strap attachment devices. FIG. 12*a* shows an apparatus 292 including tension strap attachment devices 282 and 284. In such an embodiment, a pair of tension straps would attach to form the acute angle relative to the cover's 10 apex, as in FIG. 7.

Figure 12B:
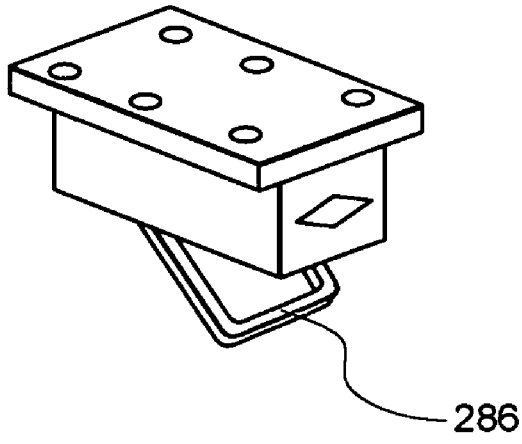

FIG. 12*b* is an alternative of FIG. 12*a* where the tension strap connection 286 is on a separate apparatus from its opposite tension strap connection. This arrangement is composed for both the port and starboard sides of the cover 10.

Figure 13A:
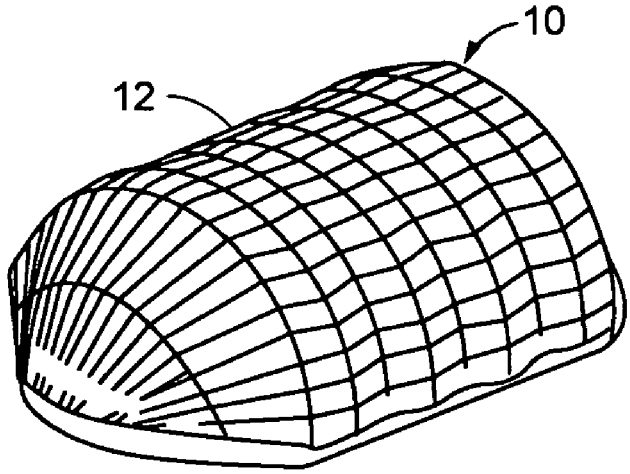
FIGS. 13(*a*) and (*b*) show several perspective views of a watercraft cover in accordance with an embodiment of the present invention.
Figure 13B:
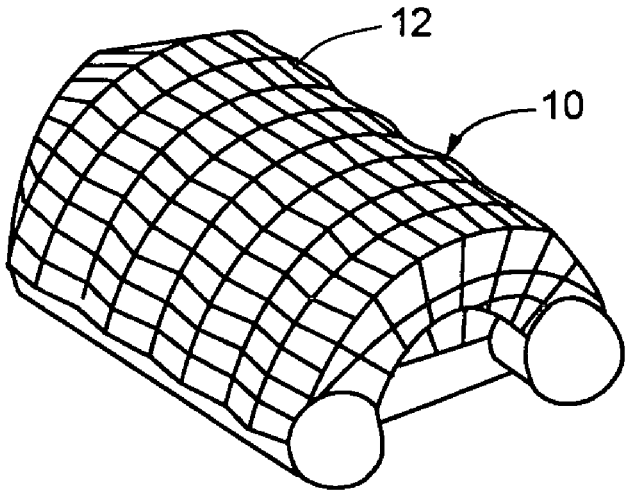

FIG. 13(*a*) shows a computer assisted design drawing of the cover 10 looking at an oblique angle from the bow to the aft. FIG. 13(*b*) shows the cover 10 from an oblique angle from the aft side looking slightly up and towards the bow end of the cover.

Figure 14A:
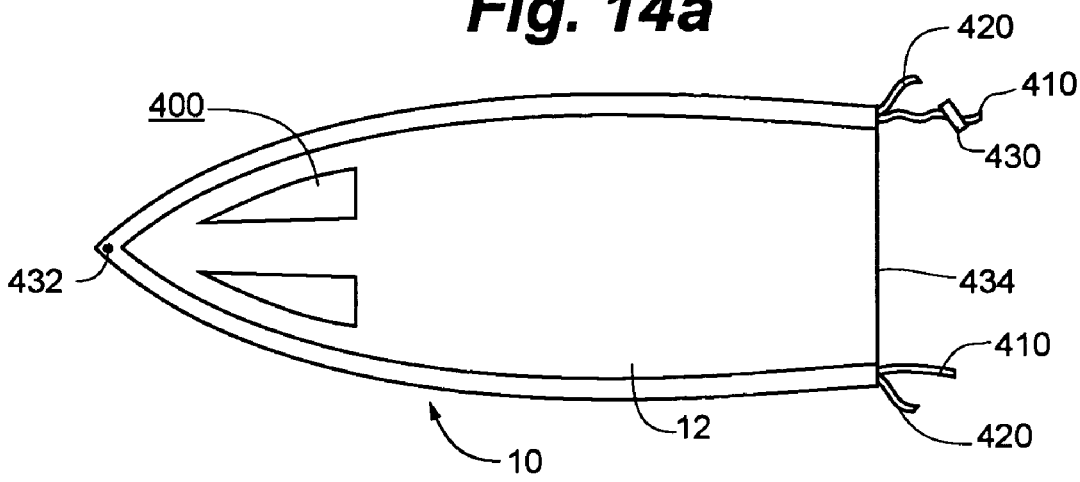
FIG. 14(*a*) is a top view of a watercraft cover in accordance with an embodiment of the present invention.
Figure 14B:
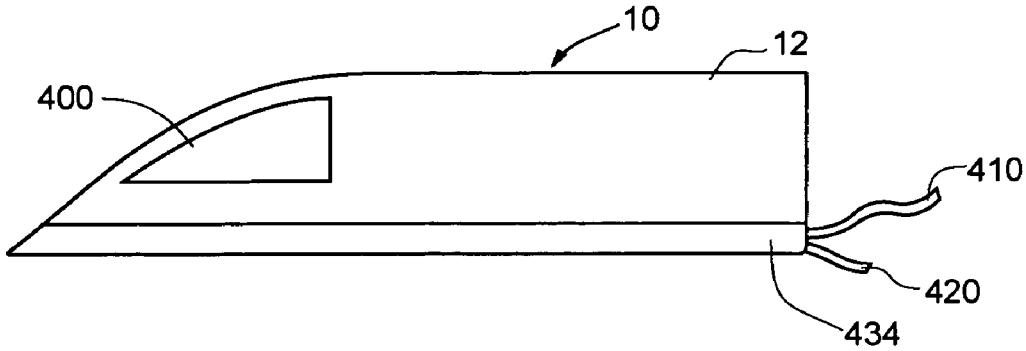

In the embodiment shown in FIGS. 14(*a*) and (*b*), the watercraft cover 10 includes at least one vent 400. Embodiments including at least one vent 400 are particularly suitable both for covering a watercraft that is docked, as well as a watercraft that is secured to a trailer and is being pulled over land at typical city and highway speeds. The at least one vent 400 is useful for admitting air into the interior of the cover 10 while the watercraft is in transit, thereby creating a positive pressure within the cover 10. The positive pressure is helpful to maintain a desired arc shape against the wind forces typically encountered at such highway speeds.

The embodiment shown in FIGS. 14(*a*) and (*b*) also includes a dual retention system. Such a system is particularly useful for rigidly securing the cover to the watercraft while reducing gapping in the sheet. The dual retention system includes a relatively inelastic cord 410 and a relatively elastic cord 420. Both cords 410 and 420 may be comprised of any material useful for retaining cover 10 to a watercraft, as will be appreciated by those reasonably skilled in the art. For example, relatively inelastic cord 410 may be a woven strap and relatively elastic cord 420 may comprise elastics. Relatively inelastic cord 410 is useful for rigidly attaching cover 10 to a watercraft, so that the cover 10 is held to the watercraft while the watercraft is in transit at highway speeds. Relatively inelastic cord 410 may comprise one or more pieces. In some embodiments relatively inelastic cord 410 may take a path from a first location proximate aft edge of sheet 12, around the front edge of sheet 12, and back to a second location proximate aft edge of sheet 12. Relatively inelastic cord 410 may be tightened with tensioner 430. Tensioner 430 may be any device useful for gathering and tightening the two ends of relatively inelastic cord 410.

Relatively elastic cord 420 is useful for gathering the sheet material 12 around the watercraft. In some embodiments, relatively elastic cord 420 is provided in two pieces, each of which has a first end attached to the sheet proximate to point 432. The other end of each of the relatively elastic cords 420 may exit a cavity or pocket defined by the sheet, or attached therto, proximate the rear end 434. Either end may include a device that allows relatively elastic cord 420 to hold tension.

Figure 15A:
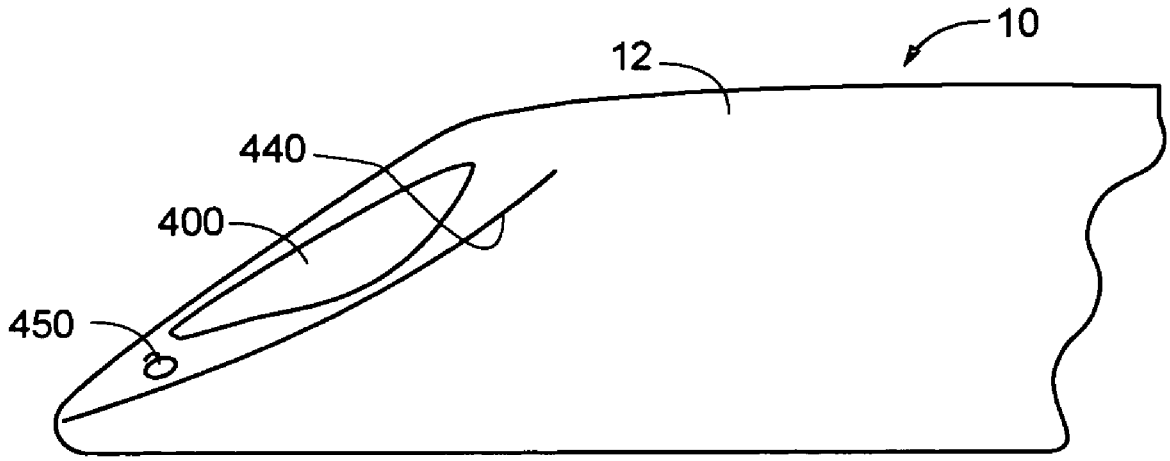
FIGS. 15(*a*) and (*b*) are partial cross-sectional side views of a watercraft cover showing a baffle and drain system in accordance with an embodiment of the present invention.
Figure 15B:
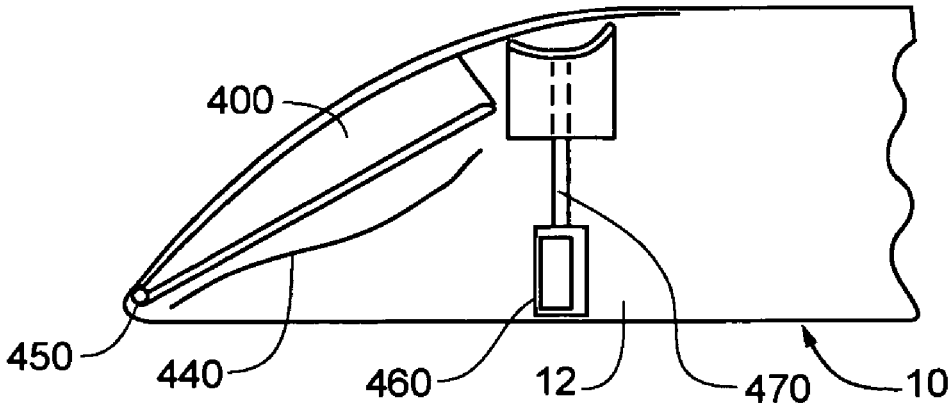

The embodiment shown in FIGS. 15(*a*) and (*b*) includes a baffle 440 and a drain 450. Baffle 440 and drain 450 are useful for collecting and discharging water that may enter the vent 400 to prevent such water from contacting the interior of the watercraft.

Figure 16A:
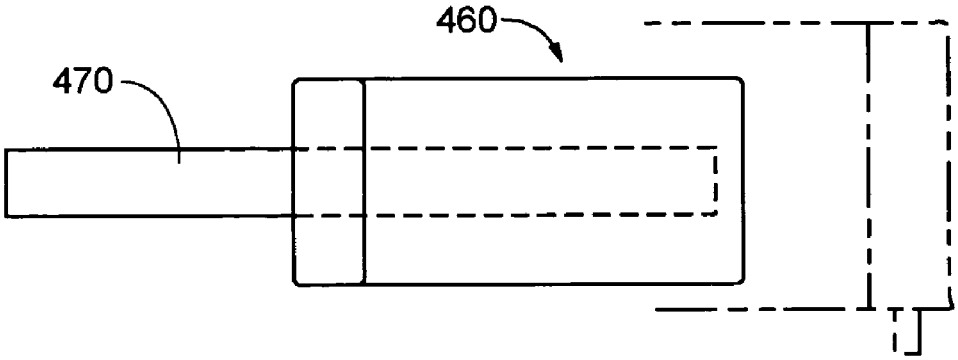
FIG. 16(*a*) is a top view of an adjustable pocket in accordance with an embodiment of the present invention.
Figure 16B:
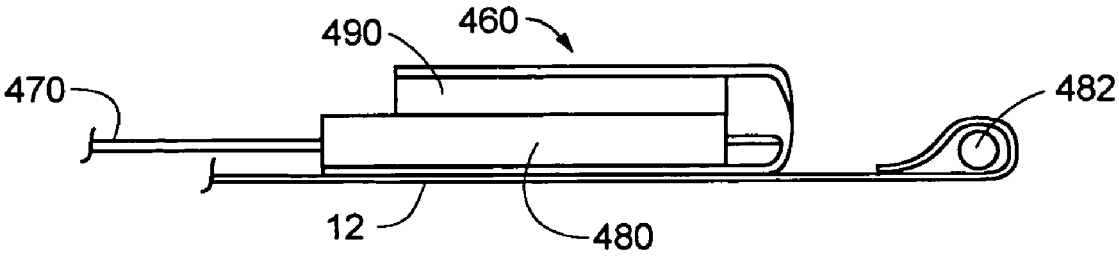
Figure 16C:
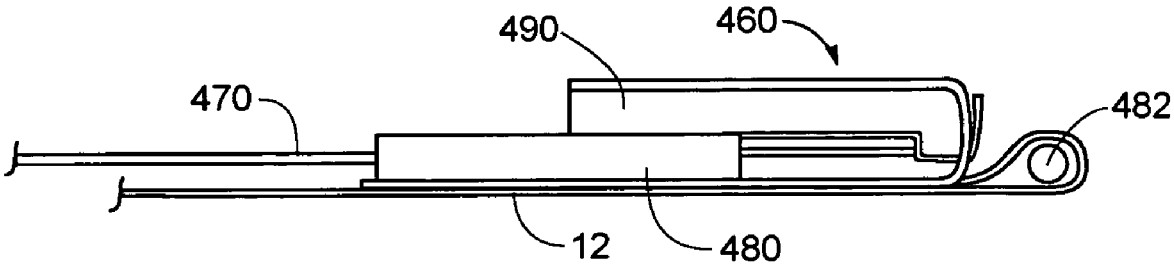

FIGS. 16(*a*)–(*c*) show an embodiment of an adjustable pocket 460 in accordance with the present invention. FIG. 16(*a*) is a top view of a closed adjustable pocket 460 with an end of a support structure 470 retained in the pocket.

FIG. 16(*b*) is an adjustable pocket 460 shown in a first position. Fixed part 480 is connected to movable part 490. Fixed part 480 is attached to the sheet 12. The support structure 470 is shown inserted into this adjustable pocket 460. Movable part 490 is of sufficient length to appropriately attach to fixed part 480 in a variety of positions. Each position carries the support structure 470 at a different depth, which changes the arc height of the cover 10. The movable part 490 and the fixed part 480 may be held together by any suitable means. For example, they may be held together by hood and loop fasteners, such as Velcro.™

FIG. 16(*c*) is an adjustable pocket shown in a second position, which shows the support structure 470 carried at a different depth than the position shown in FIG. 16(*b*). Both the adjustable pocket 460 positions of FIGS. 16(*b*) and (*c*) are shown in relation to at least one cord 482 at the edge of the sheet 12. Of course, at least one cord 482 could comprise the dual retention system described above.

Figure 17C:
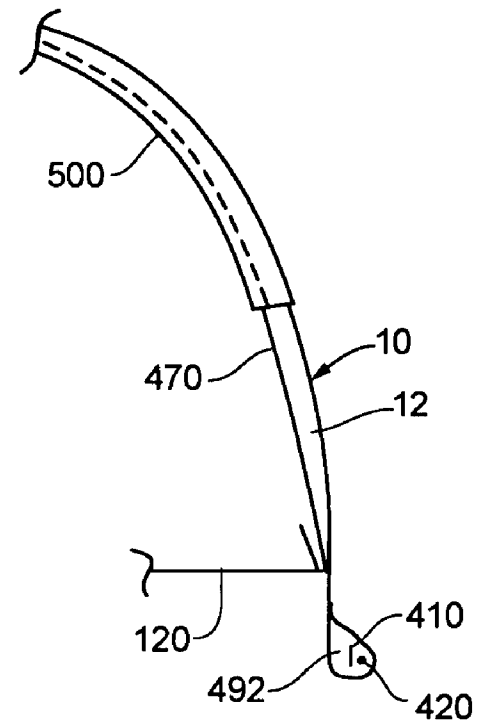
FIGS. 17(*a*)–(*c*) are cross section views of a watercraft cover showing alternative retention systems in accordance with various embodiments of the present invention.
Figure 17B:
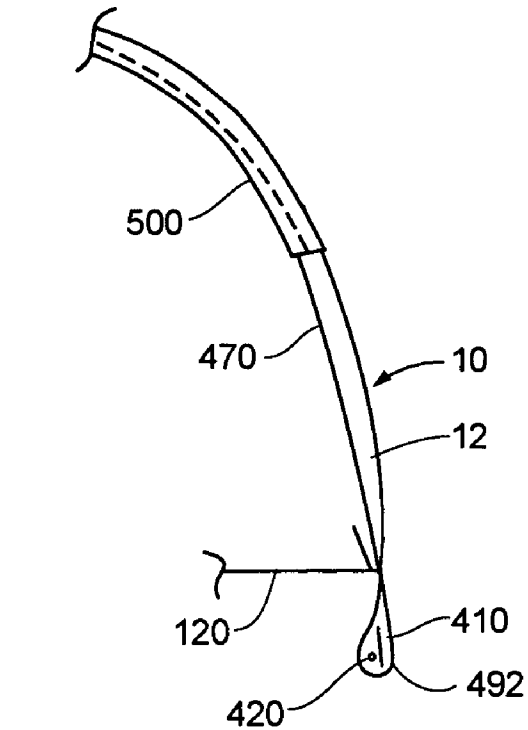
Figure 17A:
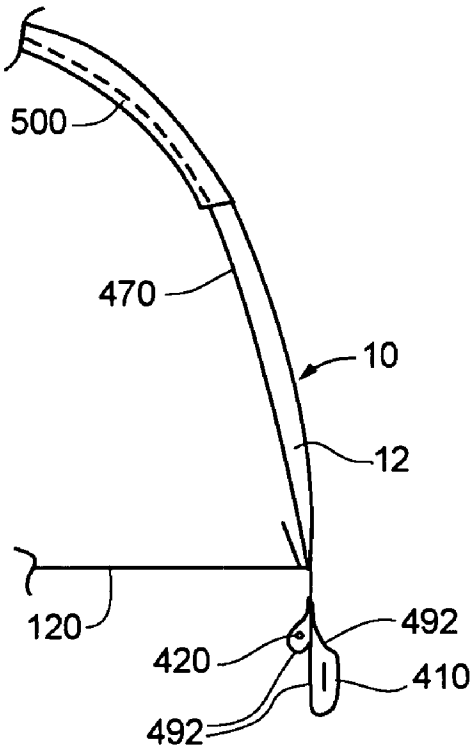

FIGS. 17 (*a*)–(*c*) show various alternative embodiments of the dual retention system. In FIG. 17(*a*), relatively inelastic cord 410 and relatively elastic cord 420 are shown is separate cord sleeves 492. In the embodiment shown in FIG. 17(*b*), relatively inelastic cord 410 and relatively elastic cord 420 are shown in one cord sleeve 492. In the embodiment shown in FIG. 17(*c*), relatively inelastic cord 410 and relatively elastic cord 420 are shown in an alternate arrangement in one cord sleeve 492. Cord sleeve 492 may be any structure suitable for retaining relatively elastic cord 420 and/or relatively inelastic cord 410, such as pockets, hooks, or loops. The cord sleeve 492 may be formed from the sheet 12 or may be attached thereto. Further, cord sleeve 492 may be located anywhere towards the distal edges of sheet 12, interior or exterior the sheet 12.

Figure 18:
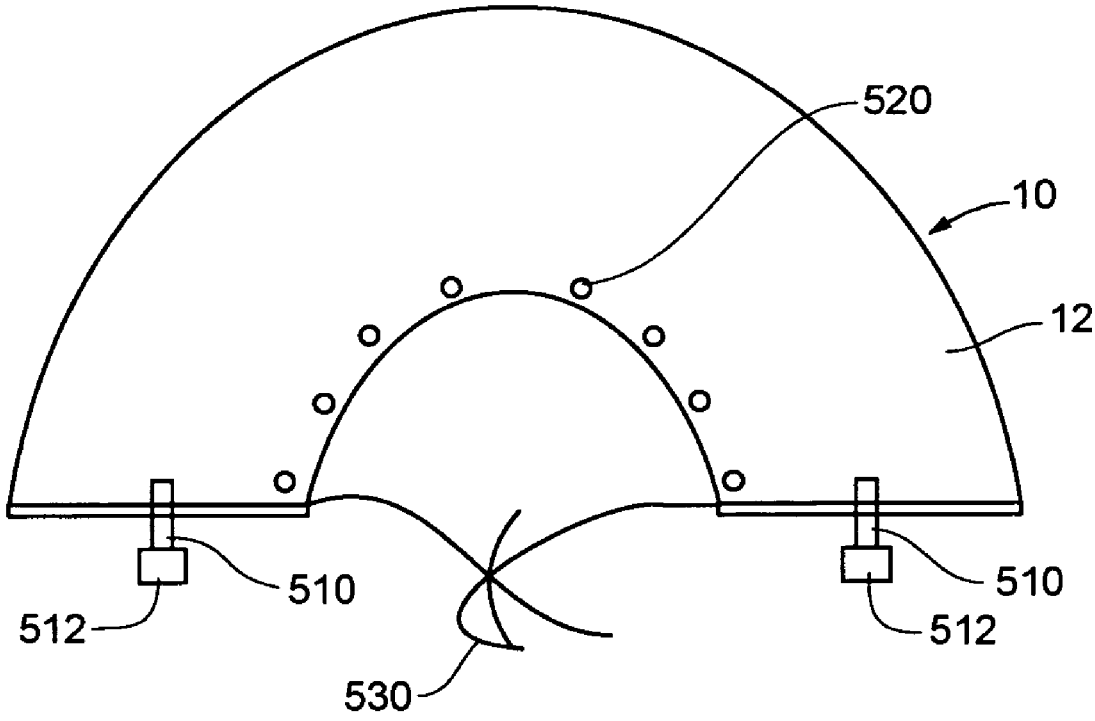
FIG. 18 is a rear view of a watercraft cover in accordance with an embodiment of the invention.

FIG. 18 shows an embodiment of a cover 10 that is designed to receive a separate cover useful for covering an external engine. In the embodiment of FIG. 18, the cover 10 includes fixing means 520 useful for fixing the separate motor cover to the cover 10. Such fixing means may include snaps, buttons, zippers, or the like.

The embodiment of FIG. 18 also includes rear retention strap 530. Rear retention strap 530 is useful for pulling the cover 10 tight underneath an externally mounted engine (not shown). Rear retention strap 530 may be provided in one or more pieces and connected by any suitable means.

The embodiment shown in FIG. 18 also includes a pair of holding straps 510. Holding straps 510 may be attached to the sheet 12, and are useful for stabilizing the cover 10 relative to a watercraft while the cover is being attached. Such a feature is particularly useful when one person is attaching the cover 10 to the watercraft. Holding straps 510 may be located anywhere on the cover 10, but are preferably located towards the aft end of the cover 10 so that they may be attached to protrusion members such as handles 512 typically found on the aft end of many watercraft (not shown).

Figure 19:
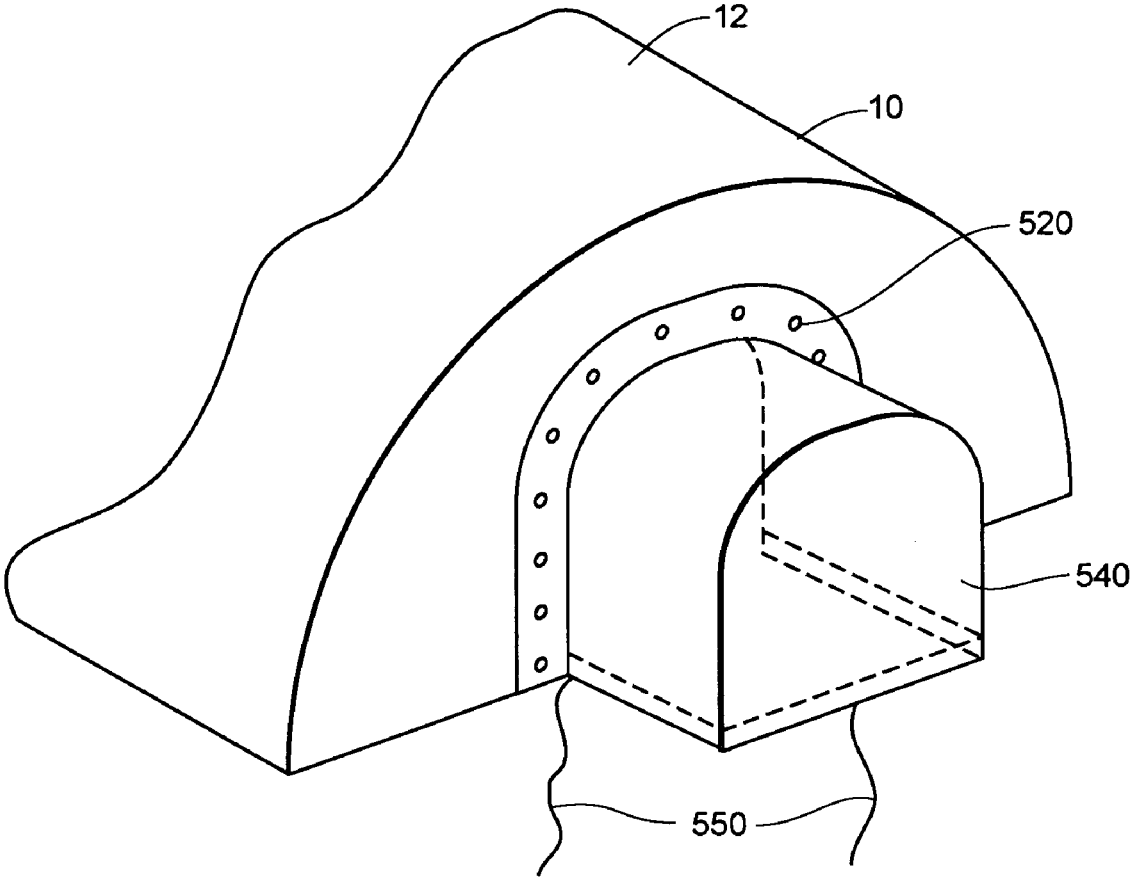
FIG. 19 is a perspective view of a watercraft cover including an engine cover in accordance with an embodiment of the present invention.

FIG. 19 shown an embodiment of a watercraft cover 10 with an engine cover 540 attached. Engine cover 540 is useful for covering an external motor (not shown). Engine cover 450 may be attached to cover 10 by the fixing means 520 discussed above. In some embodiments, an engine strap or straps 550 is provided to tighten the engine cover 540 around an external motor.

Figure 20:
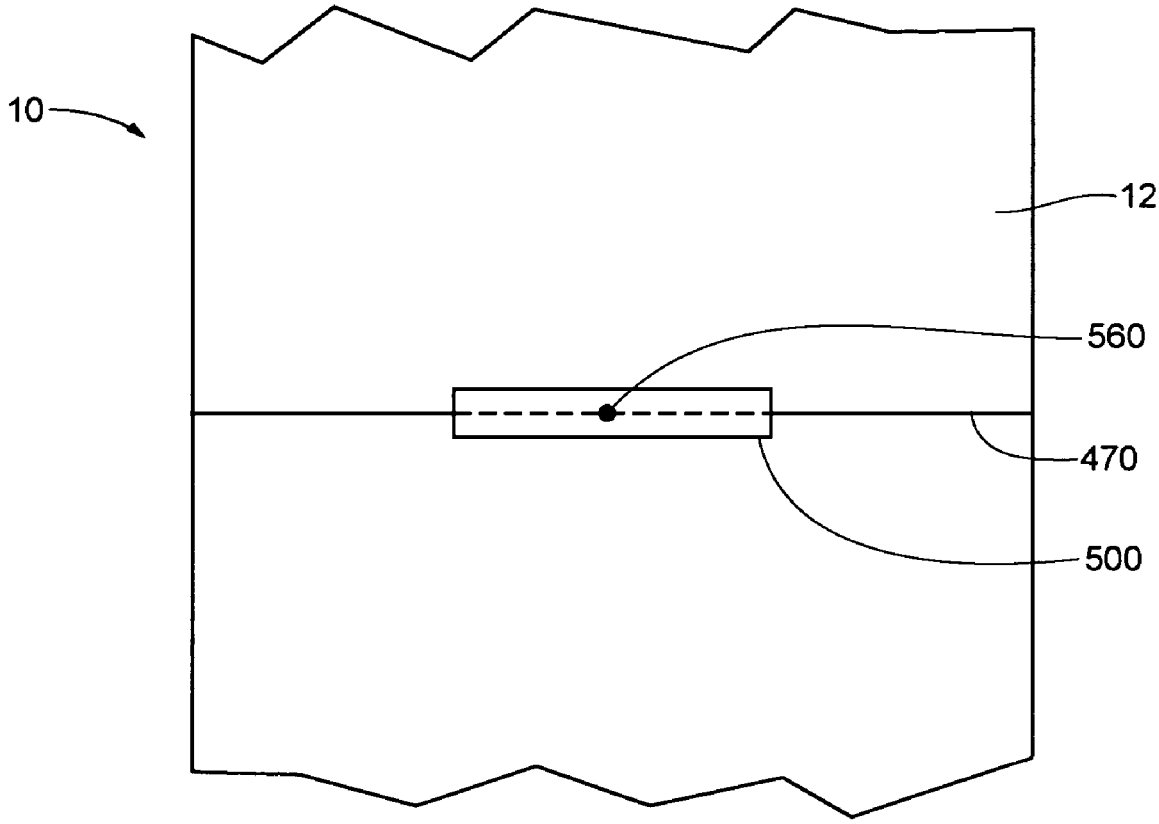
FIG. 20 is a plan view of the underside of a watercraft cover in accordance with an embodiment of the present invention.

FIG. 20 shown an interior view of a watercraft cover 10. In this embodiment, the at least one support structure 470 is normally irreversibly integrated into or retained by the sheet 12. This feature is useful for allowing the support structure 470 and the sheet 12 to be collapsible together for portability without separating the support structure 470 and sheet 12, which facilitates the ease of attaching and removing the cover 10 from the watercraft. In addition, the feature removes slack between the support structure and sheet 12, which lessens slack in the sheet 12 between the support structures and thereby reduces the amount of water collected on the sheet 12. The support structure may be irreversibly integrated into or retained by the sheet at point 560, which may be substantially centrally located between the ends of the support structure 470, the sheet 12, and/or between the pockets. The supports structure may include a notch, hole or any-other suitable structure useful for attachment at point 560. Retaining means, such as threads, nuts and bolts, rivets, or any other device may be placed through the notch or hole to attach the sheet 12 to the support structure 470. In the embodiment shown in FIG. 20, a sleeve 500 is provided to retain the support structure 470. In such an embodiment, the support structure may be attached to the sleeve 500 in the manner described above.

The present invention also includes several methods of using all of the various watercraft cover embodiments and features described above. Initially, for the first use, the watercraft cover may be sized to fit a particular boat. In this instance, the support structure may be inserted trough a sleeve and its ends inserted into the pockets. The cover may then be placed on the watercraft. The straps may be pulled together or tightened to achieve an arch shape. The width and/or height of the arch may be adjusted by providing different tensions to the strap. In embodiments so provided, the width and/or height of the arch may be further adjusted by changing the pocket depth of the adjustable pockets. The initial setup is complete after an arch shape is achieved that effectively covers the interior of the watercraft and allows for the cover to be retained against the watercraft.

After the initial setup, the cover does not need to be disassembled, and can be easily detached from the watercraft and folded in an accordion type shape. The watercraft cover in such a shape may be stored within the watercraft. In embodiments provided with flexible support structures, the cover will be flexible while in its folded state without compromising its assembly.

The watercraft cover is easily installed. In one embodiment, the watercraft cover may be placed on the watercraft and unfolded in an accordion type manner. The watercraft cover may then be secured to the watercraft. In some embodiments, the watercraft cover may be secured to the watercraft with a dual retention system as described above. In that case, the first relatively elastic cord could be tightened against the watercraft, and then the second relatively inelastic cord could be tightened against the watercraft. Of course, the order in which the cords are tightened is interchangeable. In other embodiments, the watercraft cover may be secured to the watercraft with at least three cover gathering means. In such embodiments, the cover may be secured to the aft end of the watercraft by engaging a pontoon of the watercraft with at least one of the cover gathering means. After installation, the watercraft cover may be detached and kept readily available for easy reuse.

While embodiments of the present invention have been described, it should be understood that various changes, adaptations, and modifications may be made therein without departing from the spirit of the invention and the scope of the appended claims.

What is claimed is:

1. A watercraft cover comprising:

a sheet of water repellant material;

at least two pockets attached to the sheet;

at least one support structure including an attachment structure;

a support structure sleeve attached to the sheet and located substantially between the at least two pockets; the at least one support structure extending from at least one of the at least two pockets into the sleeve and the attachment structure of the support structure being disposed in proximity to the sleeve;

at least one strap attachable to the sheet which is configured to bend the at least one support structure to form a shape which prevents water collection and deflects wind on the sheet; and at least three cover gathering means secured to the sheet and adapted for tightening of the sheet against a watercraft;

wherein the attachment structure serves to normally irreversibly integrate the at least one support structure with the sheet such that the sheet and the support structure are collapsible together for portability without separating the at least one support structure and the sheet.

2. The watercraft cover of claim 1 wherein the at least one support structure comprises at least one flexible material which allows formation of an arch shape.

3. The watercraft cover of claim 1 wherein the cover gathering means have locking mechanisms to reversibly retain a desired tension.

4. The watercraft cover of claim 1 wherein the at least one strap extends generally parallel to a beam width of the watercraft.

5. The watercraft cover of claim 1 where the at least one strap extends at an acute angle to a beam width of the watercraft.

6. The watercraft cover of claim 1, wherein at least one of the pockets is adjustable.

7. The watercraft cover of claim 1, wherein the attachment structure of the at least one support structure comprises a notch or hole through which a retaining means may be placed.

8. The watercraft cover of claim 1, wherein one of the at least three cover gathering means is configured to secure an aft end of the watercraft cover by engaging a pontoon of the watercraft.

9. A watercraft cover comprising:

a sheet of water repellant material including a support structure sleeve attached thereto;

a support structure extending into, and secured to the sheet by the support structure sleeve;

at least three cover gathering means secured to the sheet and adapted for tightening of the sheet against a watercraft, wherein one of the at least three cover gathering means is configured to secure the aft end of the watercraft cover by engaging a pontoon of the watercraft; and at least one strap attached to the sheet and configured to bend the support structure to form a shape which prevents water collection and deflects wind on the sheet.

10. The watercraft cover of claim 9 wherein:

the sheet includes a first pocket and a second pocket attached thereto, each pocket located near an edge of the sheet; and the support structure includes an end reversibly fitting into one of the pockets.

11. The watercraft cover of claim 10 wherein at least one of the pockets is adjustable.

12. The watercraft cover of claim 9 wherein the support structure comprises at least one flexible material which allows formation of an arch shape.

13. The watercraft cover of claim 9 wherein the cover gathering means have locking mechanisms to reversibly retain a desired tension.

14. The watercraft cover of claim 9 wherein the at least one strap extends generally parallel to a beam width of the watercraft.

15. The watercraft cover of claim 9 wherein the at least one strap extends at an acute angle to a beam width of the watercraft.

16. The watercraft cover of claim 9 wherein the support structure sleeve is integral with the cover.

17. A method of using a watercraft cover comprising:

providing a watercraft cover comprising a sheet of water repellant material, a first pocket and a second pocket attached to the sheet, at least one support structure, a support structure sleeve located substantially between the first and second pockets, and at least three cover gathering means secured to the sheet and adapted for tightening of the sheet against a watercraft;

inserting the first end of the support structure into at least one of the pockets, the at least one support structure extending into the sleeve;

bending the support structure to form a shape which prevents water collection and deflects wind on the sheet; and tightening the sheet against the watercraft with the at least three cover gathering means.

18. The method of claim 17, further comprising tightening the sheet against the watercraft by securing an aft end of the watercraft cover by engaging a pontoon of the watercraft with a one of the at least three cover gathering means.

* * * * *